US008425388B2

(12) United States Patent
Jostler et al.

(10) Patent No.: US 8,425,388 B2
(45) Date of Patent: Apr. 23, 2013

(54) METHOD OF SEALINGLY PACKING PIECE GOODS IN A BAG, AS WELL AS BAG UNITS ADAPTED HEREFOR

(75) Inventors: Johan Jostler, Halmstad (SE); Jan Jostler, Halmstad (SE); Sven Olof Berg, Haverdal (SE)

(73) Assignee: Pronova AB, Halmstad (SE)

( * ) Notice: Subject to any disclaimer, the term of this patent is extended or adjusted under 35 U.S.C. 154(b) by 113 days.

(21) Appl. No.: 12/300,794

(22) PCT Filed: May 25, 2007

(86) PCT No.: PCT/SE2007/000505

§ 371 (c)(1),
(2), (4) Date: Nov. 14, 2008

(87) PCT Pub. No.: WO2007/139465

PCT Pub. Date: Dec. 6, 2007

(65) Prior Publication Data

US 2009/0158695 A1 Jun. 25, 2009

(30) Foreign Application Priority Data

May 26, 2006 (SE) ..... 0601164

(51) Int. Cl.
*B31B 1/64* (2006.01)

(52) U.S. Cl.
USPC ..... 493/200; 493/189; 493/193; 493/198; 493/199; 493/227; 493/267

(58) Field of Classification Search ..... 493/214, 493/227, 223, 186, 199, 269, 210, 267, 189, 493/193, 198, 200; 53/469
See application file for complete search history.

(56) References Cited

U.S. PATENT DOCUMENTS 4,435,944 A * 3/1984 Meyer ..... 53/531
4,493,683 A * 1/1985 Jostler ..... 493/225

(Continued)

FOREIGN PATENT DOCUMENTS

EP 0 798 101 10/1997
GB 1 463 158 2/1977

(Continued)

*Primary Examiner* — Christopher Harmon
(74) *Attorney, Agent, or Firm* — Ladas & Parry LLP

(57) ABSTRACT

The present invention encompasses principally a method of permitting packaging of one or more piece goods in one or more bag units, where said bag units are, in a selected transport direction, oriented after one another and mutually united with the aid of two, each arranged bag side allocated, thickened portions. A first means (1) is disposed whereby each one of said bag units, from a folded and/or united state, becomes openable by causing said respective bag side allocated thickened portions to pass along a distance from one another oriented rails or similar arrangements. A second means (2) is disclosed in order to, in thus opened bag units, allow insertion of one or more piece goods (G). A third means (3) is utilized, whereby each one of said bag units is sealed along a sealing zone, in order thereby to allow the enclosure of said one or more piece goods. A fourth means (4) is adapted to clip and/or cut off a sealed bag through or above said sealing zone, however under said thickened portion. Two carrier strips are selected, with an upper longitudinally oriented thickened portion and lower longitudinally oriented retaining zones, where said lower retaining zones cooperate each one with an upper retaining zone for an edge portion adjacent a bag allocated opening. Said carrier strip and said bag, in a mutually coordinated position, form a bag unit.

8 Claims, 5 Drawing Sheets

U.S. PATENT DOCUMENTS

Figure 1:
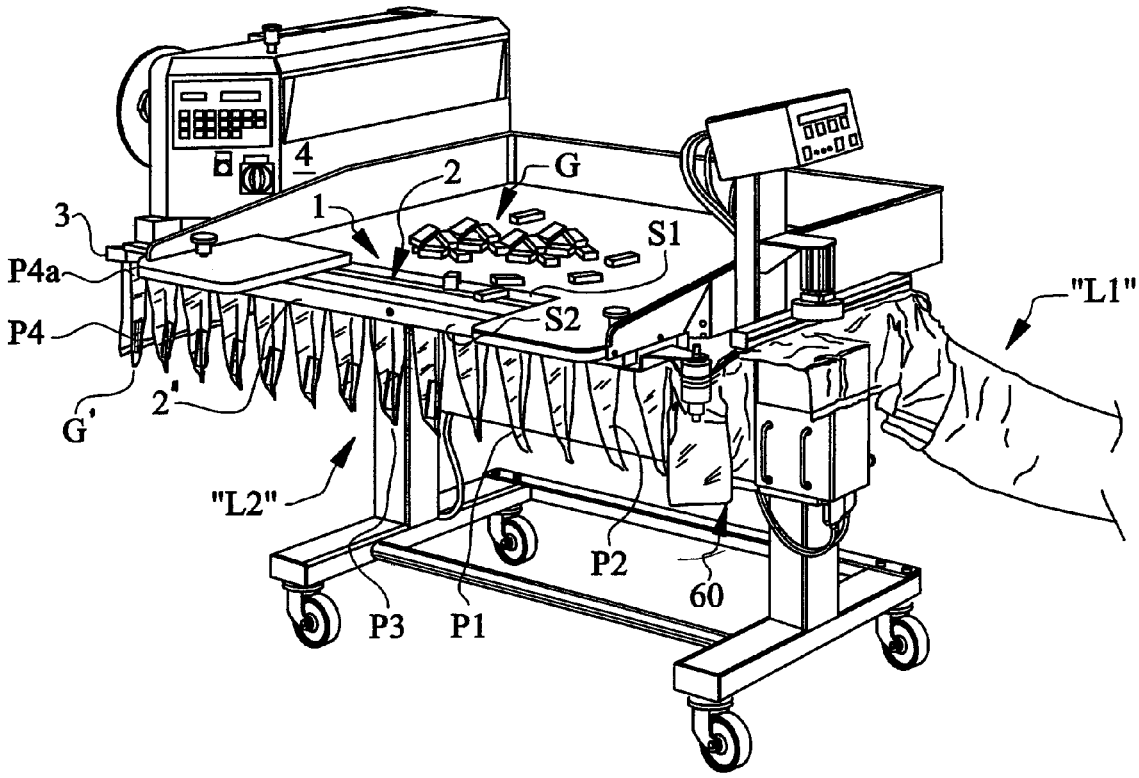

| | | | | | |
|---|---|---|---|---|---|
| 4,558,556 | A | * | 12/1985 | Jostler | 53/459 |
| 4,598,421 | A | * | 7/1986 | Jostler | 383/37 |
| 4,665,552 | A | * | 5/1987 | Lems et al. | 383/37 |
| 4,756,144 | A | * | 7/1988 | Jostler | 53/568 |
| 4,881,931 | A | * | 11/1989 | Buchman | 493/192 |
| RE34,905 | E | * | 4/1995 | Ausnit | 53/412 |
| 5,561,966 | A | * | 10/1996 | English | 53/412 |
| 5,687,549 | A | * | 11/1997 | Jostler et al. | 53/450 |
| 5,690,600 | A | * | 11/1997 | Yang et al. | 493/212 |
| 5,704,192 | A | * | 1/1998 | Jostler et al. | 53/384.1 |
| 5,733,045 | A | * | 3/1998 | Jostler et al. | 383/37 |
| 6,021,628 | A | * | 2/2000 | Jostler et al. | 53/469 |
| 6,349,523 | B1 | * | 2/2002 | Jostler et al. | 53/384.1 |
| 6,364,820 | B1 | * | 4/2002 | Jostler et al. | 493/214 |
| 7,465,265 | B2 | * | 12/2008 | Hinesley | 493/231 |

FOREIGN PATENT DOCUMENTS

| | | |
|---|---|---|
| WO | 94/19250 | 9/1994 |
| WO | 03/008272 | 1/2003 |
| WO | 2005/023693 | 3/2005 |

* cited by examiner

METHOD OF SEALINGLY PACKING PIECE GOODS IN A BAG, AS WELL AS BAG UNITS ADAPTED HEREFOR

TECHNICAL FIELD

The present invention relates in general to a method of packing one or more piece goods in one or more bag units, where said bag units are, in a selected transport direction, oriented after one another and mutually united, normally with the aid of two bag retaining and/or bag securing means allocated each to a bag side.

Means of the type contemplated here may advantageously consist of a thin strip, such as a thin plastic film of an environmentally friendly plastic material, and where the means is formed with an edge-related and elongate thickened portion and are designated hereinafter a "carrier strip" or a "transport strip".

The method proposed, according to the present invention, is based upon the utilisation of a number of series-oriented production adapted stations, seen in a production direction, hereinafter referred to as a first, a second, a third and so on means.

Thus, the present invention is based on the utilisation of a continuous web of mutually subsequent "flat" bag units, whose one end portion is adapted to cooperate each with a carrier strip and where this continuous web is to be fed from or to a first station, or a first means, where each one of said bag units is opened, from a folded and/or closed state to an opened state, by causing said carrier strip allocated to each respective bag side to pass through and past rails or similar arrangements oriented in spaced apart relationship from one another.

Through a second station, or a second means, thus opened bag units are to be fed with one or more piece goods, where said second means is to be oriented within a selected shorter extent for said first means.

The method proposed, according to the present invention, requires the utilisation of a third station, a third means, whereby each one of said opened bag units, supplied with one or more piece goods, will be closed in order thereby to cause an enclosure of said one or more piece goods.

The closure is to be selected within a closure zone, allocated to the bag unit, where this closure zone may be selected within an upper edge portion, allocated to the bag unit, but below the thickened portion of said carrier strip.

Finally, the method, according to the present invention, requires the utilisation of a fourth station, a fourth means, adapted to clip and/or cut off a thus closed bag unit above said closure zone, but under said carrier strip, in order thereby to allow the separation of a closed bag containing piece goods from a subsequent, counting in said selected transport direction, merely closed bag unit.

The present invention moreover encompasses a set, serving as semi-manufacture, of bag units intended and adapted for the method into practice.

For a greater understanding of the properties or criteria associated with the present invention, the following definitions may serve as guidance.

"folded bags" relates to a number of prefabricated bags, which may occur packed and/or coordinated and which bags display opposing bag sides united with one another to form an interior space, intended for a storage of piece goods, and with opposing bag sides adapted to form an opening, at an upper edge portion of the bag;

"bag retaining and/or bag securing means" relates to an arrangement where two carrier strips, via associated thickened portions, are displaceably disposed via their allocated rail and which may contain a "folded bag" or a bag unit suspended and where the edge portions of the carrier strips, facing away from the thickened portion each display a surface extent which is coordinable with opposing bag sides adjacent a formed opening;

"bag unit" relates to a "folded bag", an opened bag, a closed bag, with associated "bag retaining and/or bag securing means";

"closed bag unit" relates to a bag unit where an opened bag supports one or more piece goods and where the upper portion of this opened bag is closed;

"bag" relates in addition to its normally meaning, to a "closed bag unit" which has been separated from the "bag retaining and/or bag securing means";

"carrier strip" relates to a means in the form of a thin plastic film with a thickened portion along its longitudinal one (upper) edge portion and a longitudinal surface extent along its second (lower) edge portion adapted to be able fixedly to cooperate with the upper openable edge portion of a bag.

BACKGROUND OF THE INVENTION

Methods, arrangements and constructions, related to the above disclosed technical field and property, are previously known in several different embodiments.

As a first example of the background art and the technical field to which the present invention relates, mention might be made of the contents in an International Patent Application serial number: PCT/SE2002/001390, with a publication number WO-A1-2003/008272, or a Patent Publication EP-B1-1 414 700.

Said patent publication shows and describes a method and an apparatus for causing the packaging of one or more piece goods in one or more plastic bag units, where said plastic bag units are, in a selected transport direction, oriented after one another and mutually united with the aid of two strips or carrier strips allocated each to its arranged or related bag unit side and integrated with the bag and the remainder of the bag material.

In said patent publication are shown and described the utilisation of a first station, a first means, whereby each one of said folded bags, from a folded and/or closed position, become openable by causing said means, allocated to each respective bag unit side with the carrier strip, to pass rails or similar arrangements oriented in a spaced apart relationship from one another (according to FIG. 1*b*).

The patent publication discloses a method and an apparatus for guiding a packaging blank web (1) which passes a filling station (not shown), at which individual opened packaging blanks or bag units (2) are filled, whereupon said web, preferably sequentially, is advanced up to a filling station so that a filling of the bag unit (2) with piece goods takes place in a time interval formed between advancement occasions, each bag unit (2) displaying a first wall (3), a second wall (4), opposed to said first wall, with longitudinal first and second edges (5, 6), as well as a bottom portion (7).

Two zones (8, 9), transverse in respect of the longitudinal direction of the web, are to form first and second side closures (10, 11) associated with the bag unit, where the web of the bag units includes, in respect of its transport direction, transverse slits (12), which are disposed between the zones (8, 9) for two mutually adjacent bag units (2), whose each respective wall (3, 4) has two opposing edge portions (15, 16), which extend in the longitudinal direction of the web at its second edge (6).

Each one of the bag units includes a continuous retainer member (17, 18), each one cooperating with mechanical means for controlling the edge portions (15, 16) when the web (1) of the bag units is displaced through the filling station, and longitudinal slits (21, 22) being disposed on either side of the transverse slits (12) between the web (1) and the retainer members (17, 18).

It is here particularly disclosed that the retainer members (17, 18), in connection with the sequential feeding steps, are moved into slits (23) located transversely in relation to a filling station in a guide means (24), the retainer members (17, 18) being moved apart a certain extent up to the maximum opening width of the bag unit (2), at the same time as the retainer members (17, 18) are turned through an angle amounting to between 60 and 120°, clockwise and counter-clockwise, respectively, in relation to a vertical plane so that the retainer members (17, 18) and the adjacent located part of the bag unit (2) are oriented substantially horizontally, whereby all remaining bag units are oriented vertically suspended.

Machines and accessories, relating to the above disclosed technology are manufactured and marketed by PRONOVA AB, Halmstad, Sweden.

As one example of the products, which may be obtained from PRONOVA AB, relates to the above disclosed technology refers to a machine, marketed under the trade designation or brand "Sesam VS-100" and which is illustrated in the following FIG. 1 as a first example of the prior art technology, from which the present invention is developed.

"Sesam VS-100" includes a working table and thereby constitutes a complete working station and which, with the aid of allocated first means, holds the bag units in an open position for a manual insertion therein of one or more piece goods.

The machine disclosed here has proved to be flexible in that it can open and close bag units of different sizes, either vertically or horizontally oriented.

FIG. 1 illustrates that the machine is unique in that it can hold a plurality of bag units fully opened during an intermittent or continuous supply and can thereby also offer a high capacity.

The machine discloses the utilisation of a second means, in order to allow the supply to thus opened bag units of one or more piece goods, and where said second means is to be oriented within a selected extent for said first means.

Third means are also disclosed, whereby each one of said bag units is closed in order thereby to cause the enclosure of said one or more piece goods, in which event the closure is selected within a closure zone, allocated to the bag unit, and where this closure zone is selected within an upper edge portion, allocated to the bag unit but below a thickened portion allocated to the bag material and formed into a carrier strip.

Finally, the prior art technology discloses the utilisation of a fourth means, adapted to clip and/or cut off a thus closed bag unit above said closure zone but however below said thickened portion in order thereby to permit the separation of a closed bag containing piece goods as a unit, from a subsequent, counting in said selected transport direction, only closed bag unit.

The technical effect particularly emphasized in the above disclosed patent publication resides in being able, with incisions and/or slits within the upper edge region of the bag unit, to facilitate the filling of one or more piece goods and which disclosure advantageously can be utilised also in the present invention.

It should be particularly emphasized that the preconditions associated with the structure of a bag unit, integrated with two carrier strips and each with a thickened portion, is based on substantially that the same soft and thin plastic material or plastic film is present in both the bag unit proper and in the opposing thickened portions related thereto.

To provide a plastic film with edge rigidifying and particularly formed thickened portions is previously known in a first example, more particularly disclosed in the International Patent Application serial No. PCT/SE2004/001271, with publication number WO-A1-2005/023693

The present invention may be considered as a direct further development of the arrangement and those measures which are shown and described in the above first disclosed International Patent Application.

Further, the properties associated with the present invention, without any particular supplementations of the machine "Sesam VS-100", will be able to be put into use therein and thereby considerably increase the usability of this machine only by selecting a set serving as semi-manufacture, ideally wound up or zigzag-shaped set of bag units adapted for carrying out the method, where utilised carrier strips are present as a band and to which band are secured (not integrated) opposing edge portions of an openable bag, of preferably a completely different material than the plastic material which had been selected for the carrier strip.

By "semi-manufacture" is meant, according to the present invention, that a plurality of individual, prefabricated and folded together bags are to be provided with specifically structured and specifically produced bag retaining means or carrier strips, adapted to be able to extend between thickened portions allocated to the upper edge portions of the carrier strip for cooperation each with a rail and a lower surface extent, for fixedly retaining folded bags in a sequential coordination after one another, and connection zones adapted to corresponding connection zones for the upper openable edge portion of said bag.

The description uses an expression "thickened portion" and it should be observed that such a thickened portion may have different cross sections, such as circular, elliptical or other cross sections. The thickened portion is to be selected as a "strand", a thread or other thickened portion for a sliding cooperation with grooves in their allocated rail.

The present invention is based on the utilisation of one or more semi-manufactures, where each one requires a "carrier strip" formed as a plastic film structure.

A number of different such "carrier strips" and method of their production are illustrated and described in greater detail in a Swedish Patent Application serial No. 0601163-9 filed on the same day as the Swedish Patent Application serial No. 0601164-7 from which priority right is claimed in this application and under the designation or title "Carrier strip" with the same Applicant and Inventor as in this application.

The contents of the Patent Application disclosed here are to be considered as a part of the contents of this patent application.

BRIEF ACCOUNT OF THE PRESENT INVENTION

Technical Problem

Taking into account the circumstance that the technical considerations which a person skilled in the art must do in order to be able to offer a solution to one or more technical problems posed is, on the one hand, initially a necessary insight into the measures and/or the sequence of measures to be implemented and, on the other hand, a necessary selection of the means required, the following technical problems are in view hereof likely to be relevant in the evolution of the subject matter of the present invention.

Under consideration of the state of the art as described above, it is probably therefore likely to be seen as a technical problem to be able to realise the importance of, the advantages associated with and/or the technical measures and considerations which will be required in order to propose a method for sealingly packing piece goods or the like, within a bag and/or bag units adapted herefor in the form of semi-manufactures, where one or normally two carrier strips utilised are formed as semi-manufactures from a plastic material in the form of a plastic film and where, a thickened portion may be formed, via an edge folding of the plastic film, to expose a longitudinally oriented surface section or surface extent intended for a connective cooperation with a surface section of the bag related to an opening.

There resides a technical problem in being able to realise the importance of, the advantages associated with and/or the technical measures and considerations which will be required in order to offer a coordination, between the surface section or surface extent of the carrier strip and the surface section or surface extent of the bag related to the opening, where this coordination, via glue, welding or other connective methods, can be put into effect independently of selected materials or material compositions in the material of the carrier strip or selected materials or material compositions in the material of the bag in its one or both sides allocated to the carrier strip.

There resides a technical problem in being able to realise the importance of, the advantages associated with and/or the technical measures and considerations which will be required in order to propose a carrier strip, in the form of a plastic film, where a requisite thickened portion may be given the form of an edge-related thread, such as a thread of circular cross section, in the warm or hot state extruded against a thin cold plastic strip or plastic film, in order to fuse against the plastic film.

Taking into account the state of the art as described above, it is probably therefore likely to be seen as a technical problem to be able to realise the importance of, the advantages associated with and/or the technical measures and considerations which will be required in order to bifurcate a wide plastic film, to which has been applied two parallel extruded threads along a centre-related surface extent, for the simultaneous formation of parallel and two bag retaining means formed by a centre-related incision, with one such means related to each bag side.

There resides a technical problem in being able to realise the importance of, the advantages associated with and/or the technical measures and considerations which will be required in order to secure and connect an edge-related area of the carrier strip to a plurality of upper sections of a plurality of individual and prefabricated bags (folded bags).

Taking into account the state of the art as described above, it is probably likely therefore to be seen as a technical problem to be able to realise the importance of, the advantages associated with and/or the technical measures and considerations which will be required in order, by means of an arrangement with carrier strips, to be able to utilise different materials and/or material compositions in said carrier strips and in said separate and folded bags, only these sufficiently stably can secure to one another, via the connection zone, the set or adhesive criteria on the thin carrier strip must be able to be separate from set or adhesive criteria for the material in the openable edge portion of each respective bag.

Taking into account the state of the art as described above, it is probably therefore likely to be seen as a technical problem to be able to realise the importance of, the advantages associated with and/or the technical measures and considerations which will be required in order, as suitable material in the carrier strip and/or the bag, to allow the utilisation of a polypropylene material, a laminated material, such as a plastic material, and in such instance create sealed bags under sterile conditions, built up from materials suitable herefor.

Taking into account the state of the art as described above, it is probably therefore likely to be seen as a technical problem to be able to realise the importance of, the advantages associated with and/or the technical measures and considerations which will be required in order, for in any event the bag retaining carrier strip, to utilise a recoverable, environmentally friendly material, in particular a plastic material.

Taking into account the state of the art as described above, it is probably therefore likely to be seen as a technical problem to be able to realise the importance of, the advantages associated with and/or the technical measures and considerations which will be required in order, in this application, to create a hard strip or a hard strand, serving as a thickened portion, against a soft and thin plastic film, such as bag retaining carrier strip, there being ensured a low friction between one arm, formed as a rail, with a slit and the thickened portion, within said first and/or second means, in a displacement of said carrier strip along the slit.

There resides a technical problem in being able to realise the importance of, the advantages associated with and/or the technical measures and considerations which will be required in order, in this application, to cause the creation of a bag retaining and/or bag securing means or carrier strip, where each one is adapted to extend between its allocated strip or thickened portion and a connection zone against an allocated bag side of a bag within its upper openable edge portion, where a first longitudinal edge portion of the carrier strip is to be formed as or secured to said thickened portion and a second longitudinal edge portion is, via a manifest connection zone, to be securable to the upper edge portion of the bag, and where said carrier strip is to be able to be the subject matter of a clipping and/or cutting so that a thin and narrow zone, under a connection zone, will remain secured to the second edge portion of said carrier strip, when a bag containing piece goods is removed.

There resides a technical problem in being able to realise the importance of, the advantages associated with and/or the technical measures and considerations which will be required in order, in this application, to cause, via heat treatment, such as welding, the securement to in any event the one side of an elongate thin web or plastic film two parallel plastic threads or thickened portions with a selected distance between them, and where the plastic threads are preferably to be oriented centrally to said thin web or film and that a bifurcation of this thin web creates each one a bag retaining carrier strip.

There resides a technical problem in being able to realise the importance of, the advantages associated with and/or the technical measures and considerations which will be required in order, in this application, to cause said carrier strip of a bag side, adjacent a formed bag opening, to be formed as a thin web or film with one (or more) edge-related thickened portion, where a carrier strip, allocated an elongate connection zone, is to be secured to each corresponding connection zone for a plurality of separately produced single bags (folded bags), for the formation of an elongate coordination of foldable (and/or unitable) bag units.

There resides a technical problem in being able to realise the importance of, the advantages associated with and/or the technical measures and considerations which will be required in order, in this application, to allow said coordination of two carrier strips and a number of bag units to be present available as a long rollable web, a zigzag coordination or any similar coordination.

There resides a technical problem in being able to realise the importance of, the advantages associated with and/or the technical measures and considerations which will be required in order, in this application as bag retaining and/or bag securing means, in the form of two carrier strips, to allow the selection of a thin plastic material or a plastic film, and as material for the bag properties (the folded bag) to allow the selection of a considerably more rigid material.

There resides a technical problem in being able to realise the importance of, the advantages associated with and/or the technical measures and considerations which will be required in order, in this application, to permit, as said bag material, the utilisation of a first material, with a first material structure, for the folded bag's one bag side and a second material, with a second material structure, for the other bag side of the bag.

There resides a technical problem in being able to realise the importance of, the advantages associated with and/or the technical measures and considerations which will be required in order, in this application, to allow the selection of the material in the carrier strip in relation to the material in the bag so that formed opposing connection zones can be connected by means of a simple heating connection.

There resides a technical problem in being able to realise the importance of, the advantages associated with and/or the technical measures and considerations which will be required in order, in this application, to allow the creation of one, serving as a semi-manufacture, set of bag units, adapted in order to be able to be utilised in a method, defined according to one or more of the appended Method related Claims. Said bag units shall, in a selected transport direction, be oriented after one another and mutually united with the aid of one or two, carrier strips, each allocated to its apportioned bag side, where each one of said bag units, from a folded and/or united state, is openable by causing each respective bag side allocated carrier strips to pass a distance from one another in order, in thus opened bag units, to permit the insertion of one or more piece goods, where each one of said bag units is sealable, in order thereby to permit the enclosure, such as hermetic sealing, of said one or more piece goods.

The enclosure shall here be selected within a bag unit-allocated closure zone, where this closure zone is selected within a bag allocated upper edge portion, however through or under said carrier strip, and where said bag unit is clipped and/or cut off, in order thereby to permit separation of a closed bag containing piece goods from said carrier strip and from one, counting in said selected transport direction, subsequent closed bag unit and thereby to disclose that of two bag retaining and/or bag securing means, each one shall be adapted to extend between its allocated thickened portion and a connection zone, adapted to the bag side of the bag and its upper openable edge portion.

A first longitudinal edge portion for the means or the carrier strip is formed as or secured to said plastic film and a second longitudinal edge portion for the means or the carrier strip is, via said connection zone, secured to the bag's upper edge portion, a clipping and/or cutting being able to take place so that said connection zone remains secured to said carrier strip's second edge portion and thereby can be removed.

Solution

The present invention thereby takes as its point of departure the prior art, as disclosed by way of introduction, and builds on a method of causing a packing of an adapted number of one or more piece goods in one or more bag units, where said bag units are, in a selected transport direction, oriented after one another and mutually united with the aid of two means, each allocated to its apportioned bag unit side, in the form of a carrier strip, where said method principally encompasses the following steps;

a. causing the utilisation of a first station, a first means, whereby each one of said bag units, from a folded and/or united state, becomes openable by causing said respective bag unit side allocated carrier strip to pass, at a distance from one another, oriented rails or similar arrangements, b. causing the utilisation of a second station, a second means, in order to, thus according to "a" above, open bag units to cause the supply to an opened inner space of one or more piece goods and where said second means is oriented within a selected extent for said first means, according to "a" above, c. causing the utilisation of a third station, a third means, whereby each one of said bag units is closed in order thereby to permit the enclosure within the space of said one or more piece goods, the closure being selected within a bag unit allocated closure zone, where this closure zone is selected within and under a bag allocated upper edge portion, however through or under said carrier strip and/or thickened portion and d. causing the utilisation of a fourth station, a fourth means, adapted to clip and/or cut off a closed bag above said closure zone, however under said carrier strip and a connection zone, in order thereby to permit a separation of a closed bag, containing piece goods, from its allocated carrier strips and one, counting in said selected transport direction, subsequent closed bag unit.

In order to be able to solve one or more of the above disclosed technical problems, the present invention particularly discloses that the prior art be supplemented by causing the upper edge portions of the bag unit and/or the carrier strips of the bag retaining and/or bag securing means, each one to be adapted to extend between thickened portions allocated to the carrier strips and connection zones allocated to the carrier strips, as well as corresponding connection zones allocated to the bag sides of the bag unit and adjacent its upper openable edge portion, where a first, an upper, longitudinal edge portion of said carrier strip is formed as or secured to said thickened portion and a second longitudinal edge portion is, via said connection zone, secured to the upper edge portion of the bag unit, to be subject matter of a clipping and/or cutting so that corresponding connection zones remain secured to the upper edge portion of said means or bag and thereby the connection zones can be removed intact together with the remainder of the bag securing means.

As preferred embodiments, falling within the scope of the present invention's fundamental idea, it is moreover disclosed that, via heat treatment, such as hot welding, there is secured to in any event one side of an elongate thin plastic web or plastic film, serving as carrier strip, an edge-related plastic thread, preferably in that two parallel plastic threads are applied to the central portion of the plastic film, with a selected slight distance between these, and where the threads are oriented centrally to said thin plastic web and that a bifurcation of this thin plastic web can create each a carrier strip.

Said carrier strips are formed from thin plastic webs with an edge-related material thickened plastic thread, where there is secured to these allocated elongate connection zones each a corresponding connection zone for each respective one of a plurality of separately produced bags (folded bags) for the formation of an elongate coordination of folded and/or united bag units.

Said coordination of bag units can advantageously be present as a rolled up web, a zigzag structure or other coordination.

As said bag retaining and/or bag securing means or carrier strip can be selected a thin plastic material and as material for the bag proper can be selected a considerably more rigid or stiff material.

As said bag material, can now be utilised a first material, with a first material structure, for the one bag side of the bag and a second material, with a second material structure, for the other bag side of the bag.

The material in the carrier strip is selected in relation to a selected material in the bag so that formed opposing connection zones for the carrier strip and for the material of the bag can be connected by means of a simple connecting technique, preferably by means of gluing and/or heat connection.

The invention also encompasses a set serving as a semi-manufacture of bag units adapted to be able to be utilised in a method, according to one or more of the appended Method Claims, where said bag units are, in a selected transport direction, oriented after one another and mutually united with the aid of one or two, carrier strip, each allocated to an apportioned bag side, where each one of said bag units, from a folded and/or united state, is openable by causing said respective bag unit side allocated carrier strip to pass, at a distance from one another, in order in thus opened bag units to allow the insertion to an opened inner space of one or more piece goods, where each one of said bag units is closable in order thereby to allow the enclosure of said one or more piece goods within the space, the closure being selected within a bag unit allocated closure zone, where this closure zone is selected within a bag allocated upper edge portion, however through or under said carrier strips and/or thickened portion and where said bag unit is clipped and/cut off, in order thereby to permit separation of a closed bag, containing piece goods, from one, counting in said selected transport direction, subsequent closed bag unit, where two bag retaining and/or bag securing means, in the form of carrier strips, each one are to be adapted to extend between one connection zone allocated to its thickened portion and allocated to a carrier strip, adapted to a corresponding connection zone allocated to the bag's one bag side and adjacent its upper openable edge portion.

A first longitudinal edge portion of the carrier strip is formed as or secured to a strip or a thickened portion and a second longitudinal edge portion is via said connection zone, secured to a corresponding connection zone for the bag's upper edge portion, a subsequent clipping and/or cutting now can take place so that said connection zones remain secured to said carrier strip's second edge portion and releases a bag filled with piece goods.

The clipping and/or the cutting can here take place through the carrier strip's lower edge portion under said thickened portion alternatively through the bag's upper edge portion.

Advantages

The advantages which principally may be deemed to be characteristic of the present invention and the specific significative characterising features disclosed thereby are that there have hereby been created the preconditions in order, in a method according to any of the appended Method Claims and/or a composition of a semi-manufacture of bag units, to allow bag retaining and/or bag securing means in the form of parallel carrier strips, each one to be adapted to extend between its allocated thickened portion and a connection zone allocated to the carrier strip, adapted to cooperate with a connection zone allocated to the bag side of the bag and its upper openable edge portion, where a first longitudinal edge portion of the carrier strip is formed as or secured to said band and/or thickened portion and a second longitudinal edge portion is, via said connection zone, secured to a corresponding connection zone of the bag's upper edge portion, to be the subject matter of a clipping and/or cutting so that the connection zones remain secured to said means' second edge portion and that thereby the connection zones, together with the remainder of the carrier strips, can be removed as environmentally friendly waste.

That which may principally be deemed as characteristic of a method, according to the present invention, is disclosed in the characterising clause of appended Claim 1, while a semi-manufacture of series-oriented bag units is disclosed in the characterising clause of appended Claim 8.

BRIEF DESCRIPTION OF THE ACCOMPANYING DRAWINGS

Figure 2:
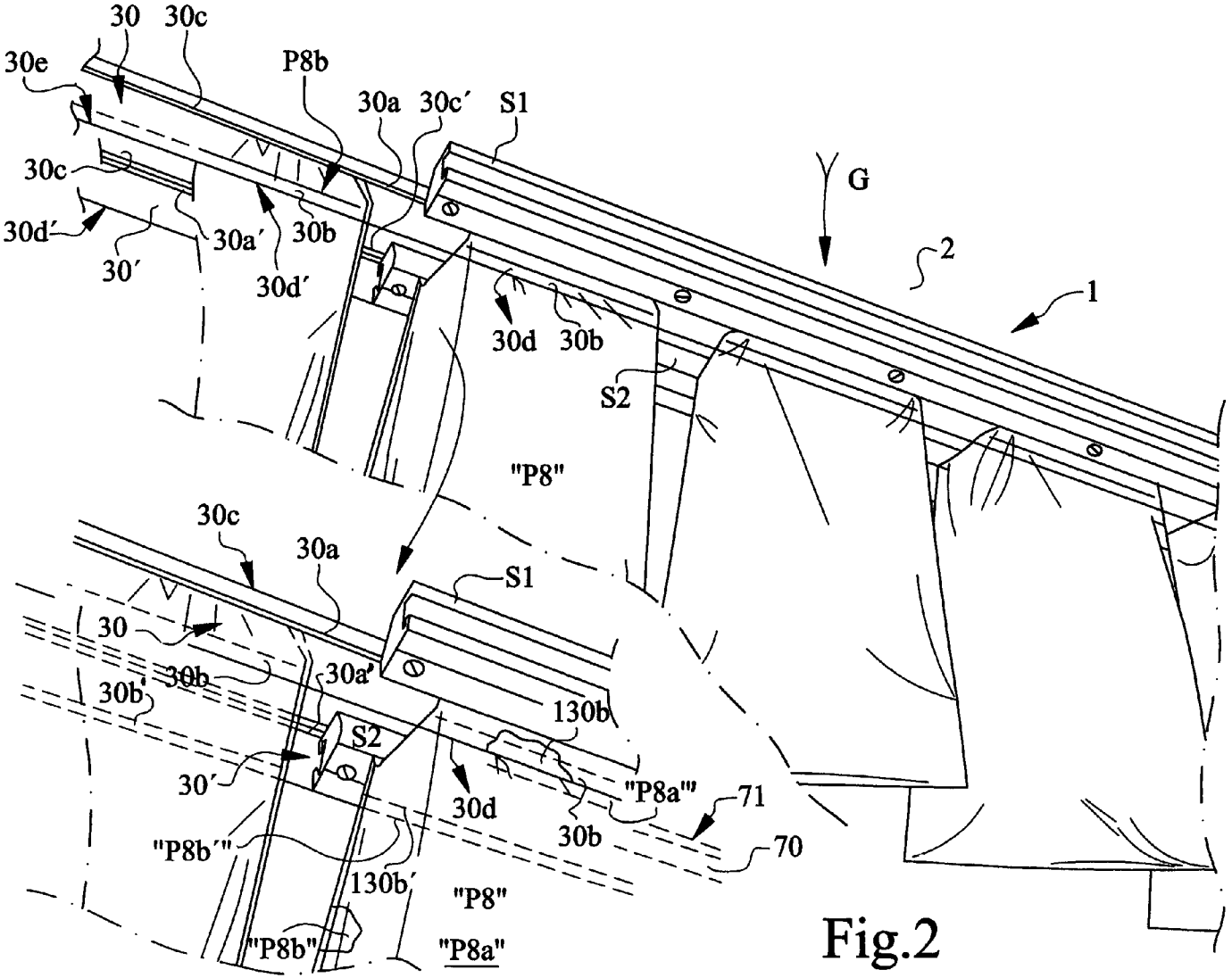
Figure 3:
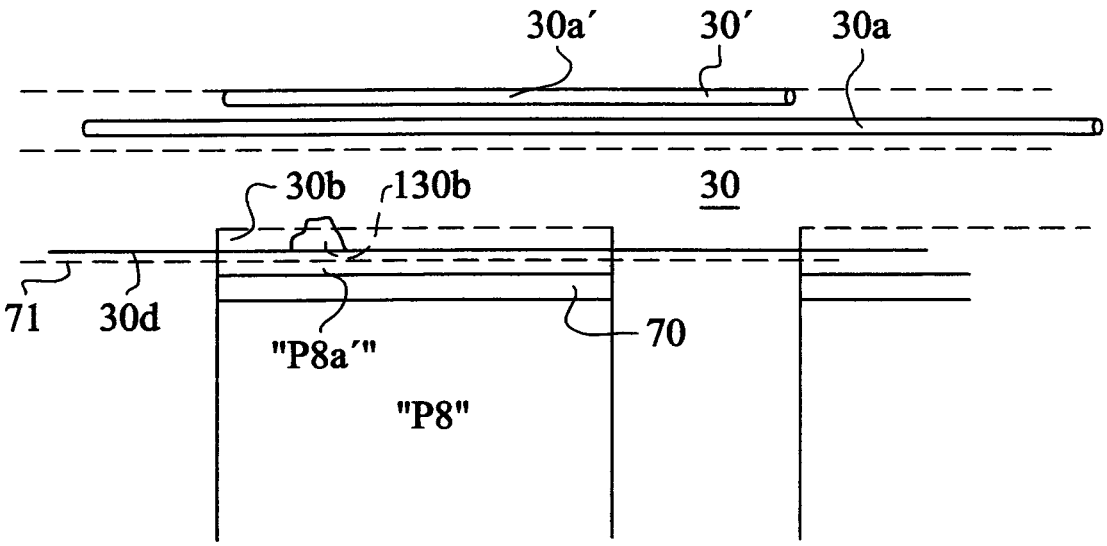
Figure 4:
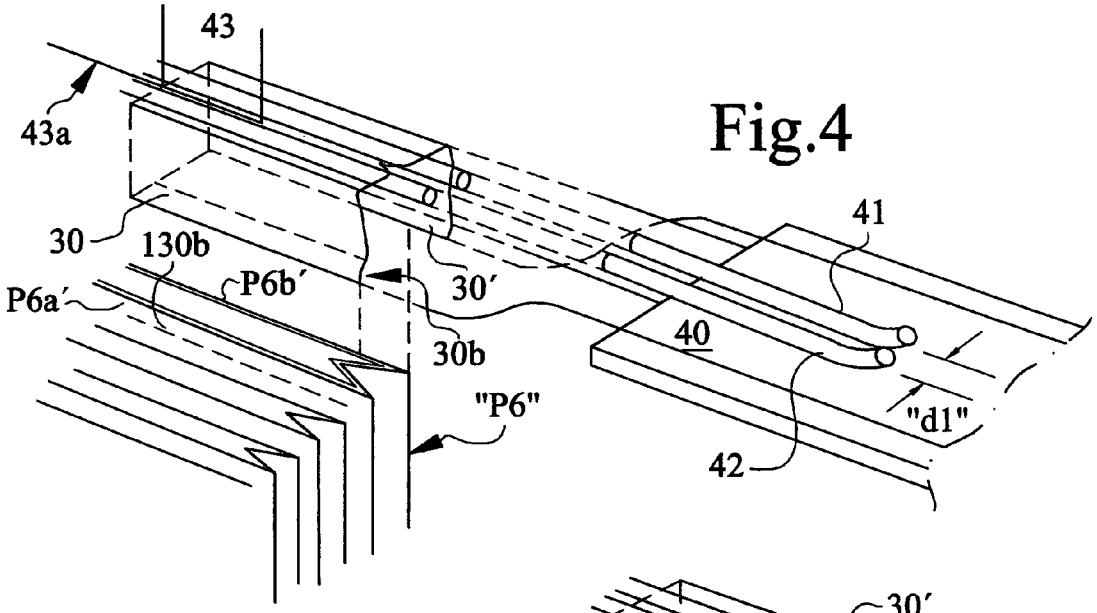
Figure 5:
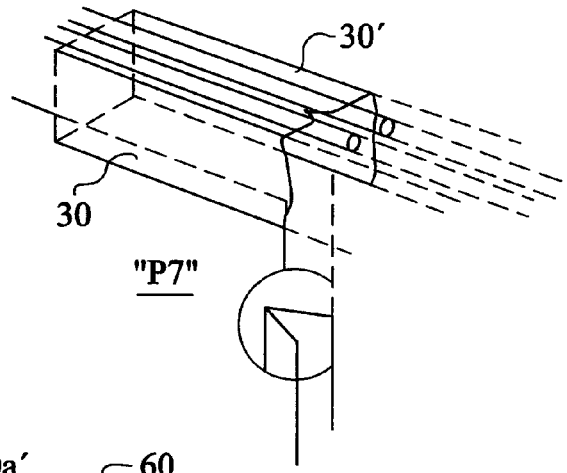
Figure 6:
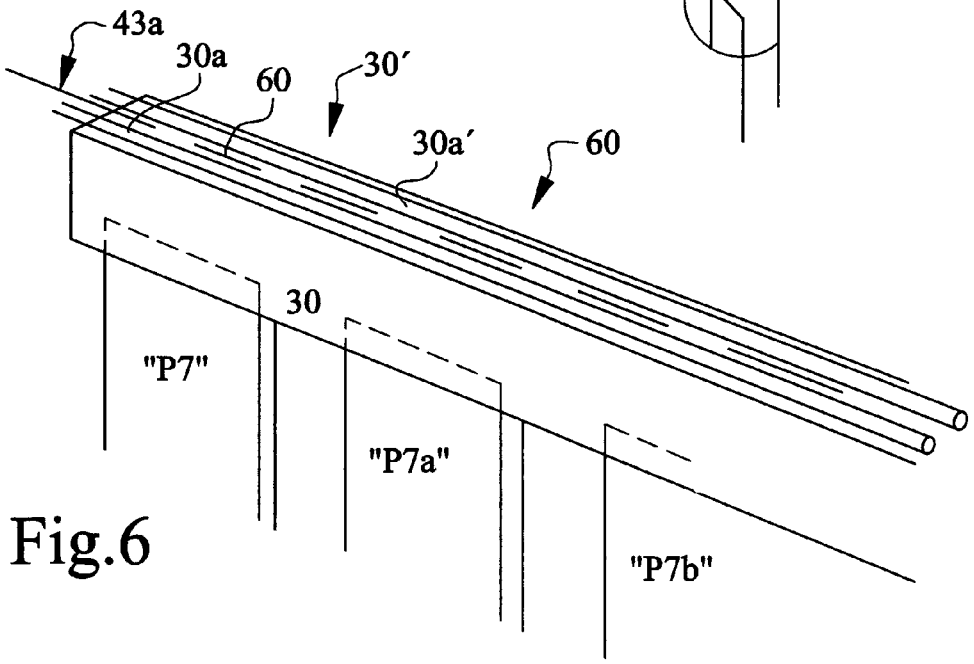
Figure 7:
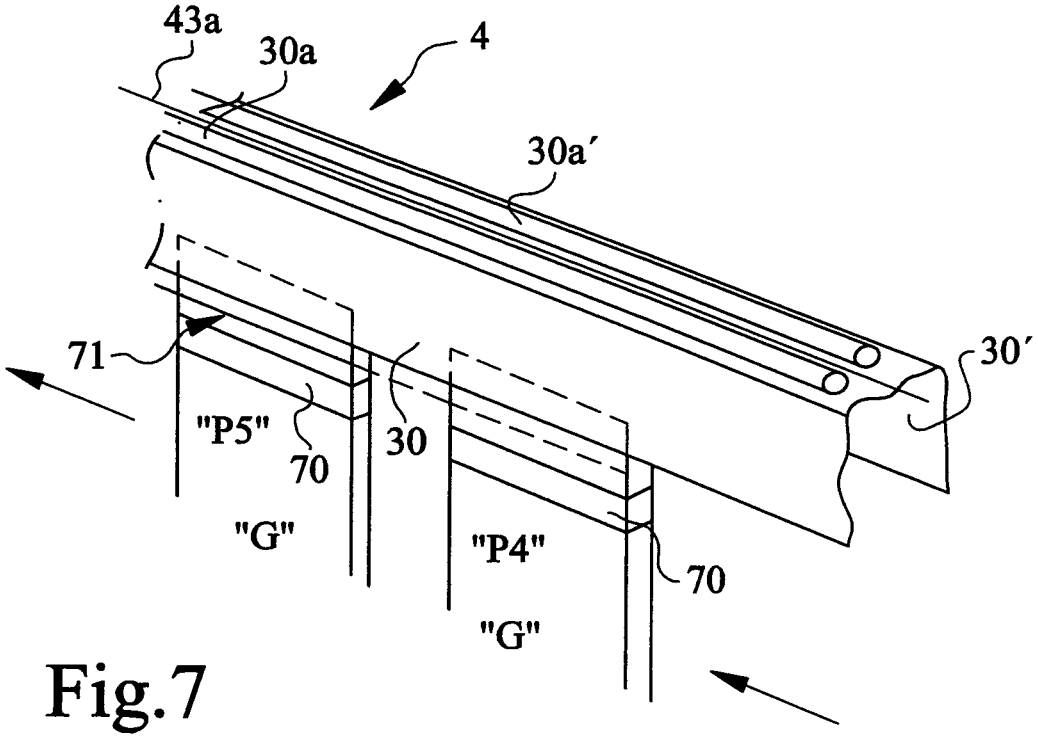

One method and a currently proposed embodiment, displaying the significative characterising features associated with the present invention, will now be described in greater detail hereinbelow for the purposes of exemplification with a reference to the accompanying Drawing, wherein;

FIG. 1 shows in perspective presentation a machine "Sesam VS-100" with a working table for a manual feeding of one or more piece goods into one or more opened bag units of a nature shown and described in greater detail in the first International Patent Application mentioned by way of introduction, FIG. 2 shows in a perspective presentation a bag unit arrangement, in accordance with the present invention, with associated two bag retaining means or carrier strips and a magnified part section, FIG. 3 shows in side elevation a slightly simplified part view of the bag unit arrangement according to FIG. 2, FIG. 4 shows a presentation of a bag retaining means or carrier strips and a securement of ready-produced and folded bags each to their carrier strip, FIG. 5 shows that a ready-produced folded empty bag has been displaced upwards for a fixed cooperation between a lower edge of said carrier strip and a there formed connection zone and a bag with a there formed corresponding connection zone, according to FIG. 4, via a not shown equipment for heat welding, FIG. 6 illustrates in a simplified form and in another perspective view a number of bag units distributed along one unit, according to FIG. 4, formed and produced into two identical carrier strips and FIG. 7 shows how one bag unit, enclosing piece goods, is sealed via a sealing zone coordinating the bag sides and how such a sealed bag unit can be cut away, for formation of a separate bag closed and containing piece goods.

DESCRIPTION OF PRIOR ART TECHNOLOGY ACCORDING TO FIG. 1

With reference to the prior art technique within this art and which is illustrated in FIG. 1, it is apparent from this perspective view the presence of a number of stations or means, which have been designated a first, a second, a third and so on means.

Thus, there is shown in FIG. 1 a machine and a method for its function in order to cause the sealing packaging of one or more selected piece goods in one or more bag units and which bag units can be separated from one or more bag retaining and/or bag securing thickened portions, for the formation of individual sealed bags.

Said bag units are, in a selected transport direction, as bag units and semi-manufacture, oriented after one another and mutually united with the aid of in any event one, normally two, each allocated bag side allocated, bands, in the form of a plastic film and a material thickened portion related thereto.

Here, use is made of a first station or a first means 1, whereby each one of said semi-manufacture adapted bag units, such as "P1", "P2", from a folded and/or united, such as rolled up, state "L1", become openable at a position "L2" by causing the respective bag side allocated thickened portions to pass, at a distance from one another oriented, rails "S1", "S2" with underjacent slits or similar arrangements for a sliding cooperation with said thickened portions.

FIG. 1 further shows a second means 2, 2', in order for thus opened bag units, such as the bag unit "P3", to supply, automatically and/or manually, one or more piece goods "G" and where said second means 2, 2' are normally oriented within a selected extent for said first means 1.

A third means 3 is also disclosed, whereby each one of said bag units "P4" is sealed in order thereby to cause the enclosure of said one or more piece goods "G", the sealing being selected within a narrow bag allocated sealing zone, oriented transversely of an infeed opening "P4*a*" of the piece goods and the bag unit "P4", where this sealing zone is selected within a bag allocated upper edge portion, however under said thickened portion.

Finally there is disclosed a fourth means 4, adapted to clip and/or cut off a thus sealed bag unit above said sealing zone, however under said thickened portion in order thereby to allow the separation of a sealed, piece goods containing, bag "P5" from a subsequent, counted in said selected transport direction, sealed bag unit "P4". (See FIG. 7.)

It should be observed that there is here utilised a bag unit where the bag's upper portion is extended so as to display material-integrated thickened portions and where the sealing zone is oriented under the thickened portions, wherefore the connection zones, according to the disclosures of the invention, do not occur.

DESCRIPTION OF CURRENTLY PROPOSED EMBODIMENT

It should by way of introduction be emphasized that in the following description of one currently proposed embodiment, which displays the significative characterising features associated with the present invention and which is clarified through the FIGS. 2 to 7 shown in the accompanying Drawings, we have allowed the selection of terms and a specific terminology with the intention in such instance principally of allowing clarification of the inventive concept.

It should however in this context be observed that expressions selected here should not be seen as restrictive exclusively to the terms utilised and selected here but it should be understood that each thus selected term is to be interpreted so that in addition it encompasses all technical equivalents which function in the same or substantially the same manner in order thereby to be able to attain the same or substantially the same intention and/or technical effect.

With a reference to the accompanying Drawings 2 to 7, there are thus shown schematically and in detail the basic preconditions of the present invention and where the significative qualities or features, associated with the present invention, have been given concrete form through the now proposed and hereinbelow more closely described embodiment.

It should be noted that the description of the prior art technology, illustrated in FIG. 1, may serve as the basic preconditions for an understanding of the present invention.

The present invention concentrates on specially formed bag unit retaining and/or bag securing means, which are illustrated as carrier strips and which in int. al. FIGS. 2 and 3 have been given reference numeral 30 or 30'.

Such a carrier strip 30 (or 30') consists of a wide thin plastic film, whose upper longitudinal oriented edge is folded or formed as or given a thickened portion and whose lower longitudinal oriented edge is intended to serve as a connection zone to a corresponding connection zone related to a bag's opening-related edge portion.

In the following description use is made, according to FIG. 4, initially of a plastic film 40 to which has been applied one or two plastic strands 41 and 42 as well as a plurality of ready-produced bags, where one has been allocated reference numeral "P6", and where these bags are here shown laterally related to one another with the openings facing upwards.

The ready-produced bag "P6" shall, according to FIG. 5, be lifted up to a cooperation with its allocated means 30 respectively 30' or carrier strip.

In such a cooperation there is formed a longitudinal orientation of bag units "P7", "P7*a*", "P7*b*" without piece goods "G", where each respective bag is via its connection zones secured to said means 30 respectively 30' or carrier strip at an adapted free distance between adjacent bags.

In FIG. 2 it is illustrated, in particular in the magnified part section, that each one of requisite two means 30, 30' are to be adapted to be allowed to extend between its allocated strip 30*a*, 30*a'*, strand and/or thickened portion and a connection zone 30*b*, 30*b'* for the means 30, 30'.

The bag's "P8" one side "P8*a*" is adjacent its upper portion "P8*a*'" formed with a connection zone 130*b*.

The bag's other side "P8*b*" is adjacent its upper portion "P8*b*'" formed with a connection zone 130*b'*.

A first longitudinal edge portion 30*c* (30*c'*) for the means 30 (30') is formed as or secured to said band 30*a* (30*a'*) and a second longitudinal edge portion 30*d* (30*d'*) for said means 30, is via a connection zone 30*b* (30*b'*), secured to the bag unit's upper edge portion and there formed connection zones 130*b* (130*b'*).

FIG. 6 then permits an illustration that a plurality of coordinated bag units, such as "P7, "P7*a*" "P7*b*" is to be advanced as a band-related set 60 with the bags' sides mutually united by the means 30, 30'.

FIG. 7 allows the illustration that a piece goods "G" enclosing and via a sealing zone 70 sealed bag unit "P4" can be cut off from the means 30, 30' at an incision line 71, in order to first release bag "P5" and thereafter bag "P4" from the means 30 and 31.

Via a heat treatment, according to FIG. 4, such as welding, there is secured to in any event the one side of an elongate thin plastic web or film 40 two extruded parallel and by the extrusion warm or hot threads 41, 42 or thickened portions, with a selected distance "d1" between these, and where the threads are oriented centrally to said thin web or film 40. A bifurcation, via a knife arrangement 43 and an incision line 43*a* of this thin web 40, creates after bending each means or carrier strip 30, 30'.

As said bag retaining and/or bag securing means or carrier strip 30, 30' there is selected a thin plastic material or plastic film 40, however as material for the bag "P8" can be selected an optional and ideally considerably more rigid material.

As said bag material can, as FIGS. 2 and 3 illustrate, then be utilised a first material, with a first material structure, for the bag unit's "P8" one bag side "P8*a*" and a second material, with a second material structure, for the bag unit's "P8" other bag side "P8*b*". Nothing prevents that the one bag side consists of a transparent material while the other bag side consists of a thicker and more rigid material.

The material in the means or strips 30, 30' can be selected in relation to the material in the bag "P8" so that formed opposing connection zones 30*b*, 130*b*; 30*b*', 130*b*' can be connected by means of a known heat connection.

The invention also discloses as semi-manufacture serving set 60 of bag units (FIG. 6), adapted to be able to be utilised in a method according to one or more of the appended Method Claims, where said bag units are, in a selected transport direction, oriented after and separate from one another "P7", "P7*a*", "P7*b*" and mutually united with the aid of two, each arranged bag side allocated, band or carrier strip 30, 30', where each one of said bags, by said carrier strip, from a folded and/or united state (FIG. 4), is openable, within a second means 2, by causing said respective bag side allocated carrier strip 30, 30' to pass at a distance from one another in order to, in an thus opened state, each bag allows the insertion to an opened space one or more piece goods "G", where each one of said bag units is sealable 70 in order thereby to permit a tight enclosure of said one or more piece goods "G".

The sealing shall here be selected within a bag unit allocated sealing zone 70, where this sealing zone is selected to a position within a bag allocated upper edge portion "P8*a*'" respectively "P8*b*'", however under said band or carrier strips 30*a*, 30*a*' and where said bag unit is clipped 71 and/or cut off, in order thereby to allow separation of a sealed, piece goods containing, bag "P5" from one, counted in said selected transport direction, subsequent, however closed, bag unit "P4" and supported by said carrier strips.

A clipping and/or cutting along a line 71 takes place so that said connection zones 30*b*, 130*b*; 30*b*', 130*b*' remain secured to said means' or carrier strips' 30, 30' second edge portions 30*d*, 30*d*'.

The invention is naturally not restricted to the embodiment disclosed above by way of example but may undergo modifications without departing from the inventive concept illustrated in the appended Claims.

Specially it should be observed that each shown unit and/or circuit can be combined with each other shown unit and/or circuit without departing from the scope in order thereby to attain the desired technical function.

The invention claimed is:

1. A method for packing one or more pieces of goods in one or more bag units oriented one after another in a transport direction, the method comprising the steps of:

a1. providing a plurality of carrier strips each of which is produced by attaching at least one thread onto one side of an elongate thin film;

a2. providing a plurality of bag units, including first and second bag units of predetermined width, each of the plurality of carrier strips having a width that is greater than the width of each of the plurality of bag units so as to allow for the first and second bag units to be attached to and carried by the plurality of carrier strips at the same time with the first and second bag units spaced from each other; each of the first and second bag units having opposite sides defining an inner space therebetween, b. sequentially attaching each of the opposite sides of the respective first and second bag units to respective of the carrier strips;

c. sequentially opening said first and second bag units to provide an opening to the inner space of each of the bag units by passing the threads of the respective carrier strips of the first and second bag units through rail means at a distance from one another, d. sequentially inserting one or more pieces of goods into the opened inner space of each of the first and second bag units, e. sequentially sealing said opening of said inner space of each of said first and second bag units within or adjacent a bag sealing zone, said sealing zone being selected within a bag unit allocated upper edge portion, below said threads, and f. sequentially cutting each of the sealed first and second bag units within or above said sealing zone, below said threads, to separate the sealed, first and second bag units from the threads.

2. A method according to claim 1, wherein said plurality of bag units are rolled up or folded in a zigzag arrangement in a carton or corresponding container.

3. A method according to claim 1, wherein one of the opposite sides of the first bag unit is made of a first material, and the other side of the opposite sides of the first bag unit is made of a second material.

4. A method according to claim 1, wherein the carrier strips are made of a material which is selected such that the carrier strips can be attached to the opposite sides of the bag unit by means of heat connection.

5. A method according to claim 1, wherein said rail means includes rails defining grooves, and the step of opening includes sliding the thickened portions along the grooves in the rails.

6. A method according to claim 1, wherein said carrier strips are produced by:

providing an elongated thin film;

attaching two parallel threads at a distance therebetween, centrally on said elongated thin film; and bifurcating said elongated thin film between the threads to form said carrier strips.

7. A method according to claim 1, wherein each of said carrier strips comprises a lower retaining zone and each of the opposite sides of said first bag unit comprises an upper retaining zone secured to the lower retaining zone of said respective carrier strip; and wherein said step of cutting takes place within or adjacent to the retaining zones of the carrier strips and the bag unit.

8. The method according to claim 1, wherein the plurality of carrier strips are of a different composition than the plurality of bag units.

* * * * *